US007943873B2

(12) United States Patent
Gopikrishnan Babu et al.

(10) Patent No.: US 7,943,873 B2
(45) Date of Patent: May 17, 2011

(54) CIRCUIT BREAKER WITH LOCKING MECHANISM

(75) Inventors: Triplicane Gopikrishnan Babu, Andhra Pradesh (IN); Janakiraman Narayanan, Andra Pradesh (IN); Amit Bose, Secunderabad (IN); Soundararajan Narayanasamy, Hyderabad (IN)

(73) Assignee: General Electric Company, Schenectady, NY (US)

( * ) Notice: Subject to any disclaimer, the term of this patent is extended or adjusted under 35 U.S.C. 154(b) by 439 days.

(21) Appl. No.: 12/103,225

(22) Filed: Apr. 15, 2008

(65) Prior Publication Data

US 2009/0255786 A1 Oct. 15, 2009

(51) Int. Cl.
*H01H 9/28* (2006.01)

(52) U.S. Cl. ..... 200/43.14

(58) Field of Classification Search ..... 200/43.14, 200/43.11, 43.01, 43.16, 318, 321
See application file for complete search history.

(56) References Cited

U.S. PATENT DOCUMENTS 5,477,016 A * 12/1995 Baginski et al. ..... 200/43.11
5,782,341 A * 7/1998 Calder et al. ..... 200/43.14
6,472,620 B2 * 10/2002 Rane et al. ..... 200/50.26

* cited by examiner

*Primary Examiner* — Edwin A. Leon
*Assistant Examiner* — Vanessa Girardi
(74) *Attorney, Agent, or Firm* — Global Patent Operation; Stephen G. Midgley

(57) ABSTRACT

A circuit breaker with a locking mechanism is provided, which ensures that circuit breaker is switched OFF before applying any trip free locks. The circuit breaker includes a lay shaft coupled to the circuit breaker contacts, a lay shaft cam coupled to the lay shaft, a lifting plate configured to interface with the lay shaft cam, and a padlock plate configured to engage the lifting plate.

12 Claims, 7 Drawing Sheets

CIRCUIT BREAKER WITH LOCKING MECHANISM

BACKGROUND

The subject invention relates to circuit breakers, and more particularly the subject invention relates to a mechanical linkage arrangement for a circuit breaker to ensure that the circuit breaker is off before applying a padlock.

A circuit breaker is an automatically operated electrical switch designed to protect an electrical circuit from damage caused by overload or short circuit. Unlike a fuse, which operates once and then has to be replaced, a circuit breaker can be reset (either manually or automatically) to resume normal operation. A switch mechanism of the breaker can then be thrown to open and close contacts to which the load is connected. A drawout circuit breaker is a specific type of circuit breaker configuration that is designed to be racked into and out of power equipment to connect and disconnect the circuit breaker to an electrical power source and load circuit. Mechanisms for drawout circuit breakers are typically provided for insuring that drawout circuit breakers cannot be physically connected between a line and load when the breaker is in the contacts-closed position. Many regulations require that a circuit breaker is switch off before applying padlocks and key interlocks.

It is desirable to provide an interlock mechanism that allows circuit breakers to be switched OFF before applying a locking mechanism.

BRIEF DESCRIPTION OF THE INVENTION

Exemplary embodiments include a circuit breaker apparatus, including a lay shaft coupled to circuit breaker contacts, a lay shaft cam coupled to the lay shaft, a lifting plate configured to interface the lay shaft cam and a padlock plate configured to engage the lifting plate.

Further exemplary embodiments include a circuit breaker system, the system including a circuit breaker having circuit breaker contacts and configured in an OFF condition, a padlock plate disposed on the circuit breaker, wherein the engagement of the padlock locks the circuit breaker into a trip free condition and a locking mechanism configured to lock the circuit breaker in the OFF condition in response to the engagement of the padlock plate.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In exemplary embodiments, the systems described herein include an arrangement of linkages, which ensures that a circuit breaker is switched OFF by pressing a manual OFF button or by activation of trip coils before applying any trip free locks. In exemplary embodiments, a vertical lever (lifting plate) is mounted on a side sheet of a circuit breaker mechanism in reciprocating manner. In exemplary embodiments, when this vertical lever is displaced upward, the vertical lever retains the trip shaft in tripped position. Furthermore, the vertical lever includes an interfacing (lifting) profile that senses a position of a mechanical lay shaft (cam) of the lay shaft (which indirectly senses a position of the contact of the circuit breaker if the contact is closed or open). In exemplary embodiments, the vertical movement of the lifting lever is blocked by a blocking pin attached to the mechanical lay shaft cam in a closed position of the lay shaft, such that the vertical lever can be displaced upward only when the contacts are open (i.e., the mechanical lay shaft is in an open position). In exemplary embodiments, as further described herein, all the locking devices are interfacing with the vertical lever to apply a lock to the circuit breaker.

Figure 1:
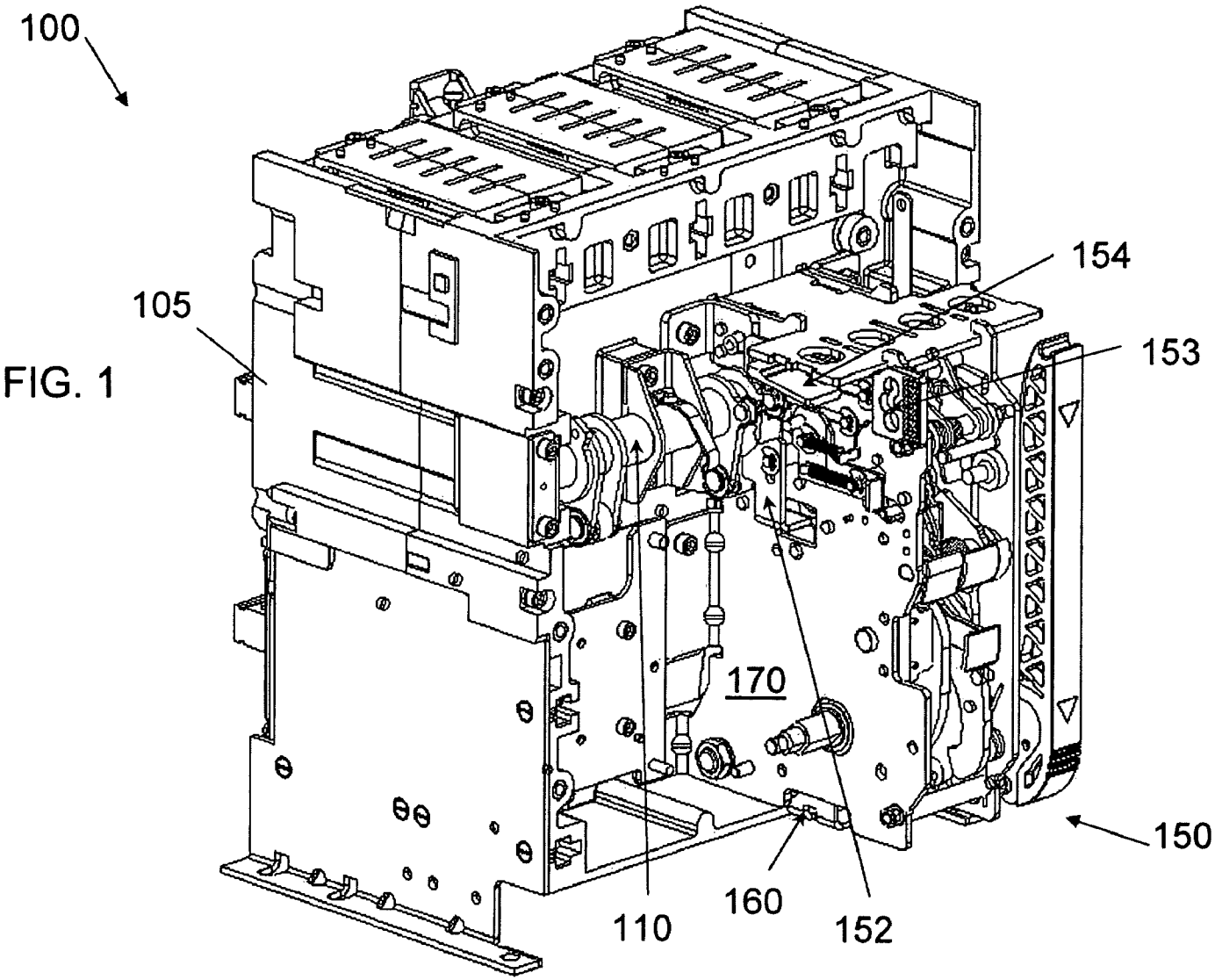
FIG. 1 illustrates a perspective view of a circuit breaker assembly in accordance with exemplary embodiments.

FIG. 1 illustrates a perspective view of a circuit breaker assembly 100 in accordance with exemplary embodiments. The assembly 100 includes a breaker housing 105, a circuit breaker 150 disposed within the housing 105 and a lay shaft 110 disposed within the housing 105 and coupled to the circuit breaker 150. In exemplary embodiments, the circuit breaker 150 further includes a lifting plate (vertical lever) 152 disposed adjacent a side wall 170 of the circuit breaker 150. In exemplary embodiments, the lifting plate 152 includes a lifting plate slot 160 disposed on one end of the lifting plate 152. As described further herein the lifting plate slot is configured to receive a key lock lever (161, see FIG. 6). In exemplary embodiments, the circuit breaker 150 further includes a padlock plate 153 disposed adjacent the sidewall 170. The lifting plate 152 and the padlock plate 153 are coupled to Trip paddle 154.

Figure 3B:
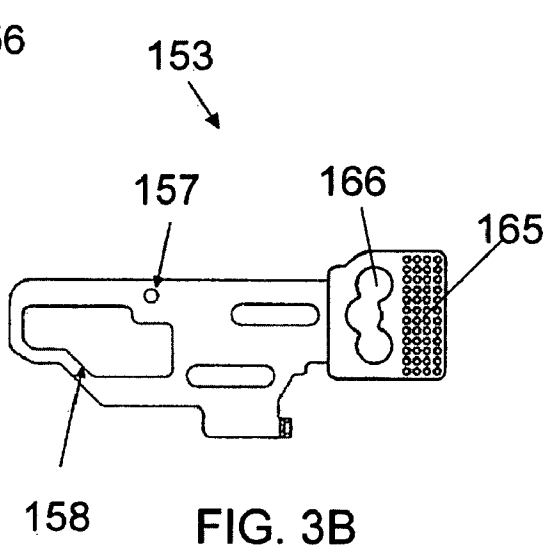
FIG. 3B illustrates a side view of an exemplary padlock plate.
Figure 3A:
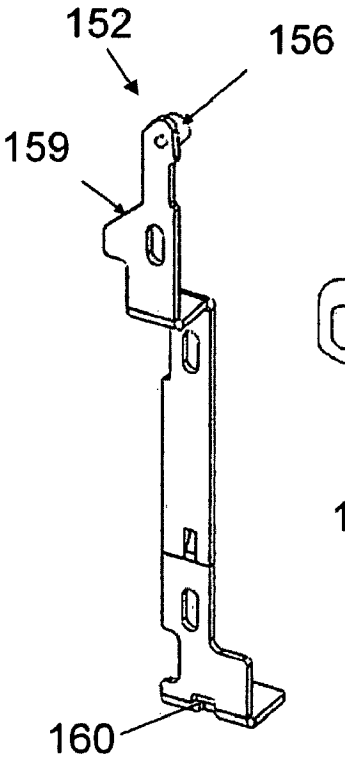
FIG. 3A illustrates a side view of an exemplary lifting plate.
Figure 2:
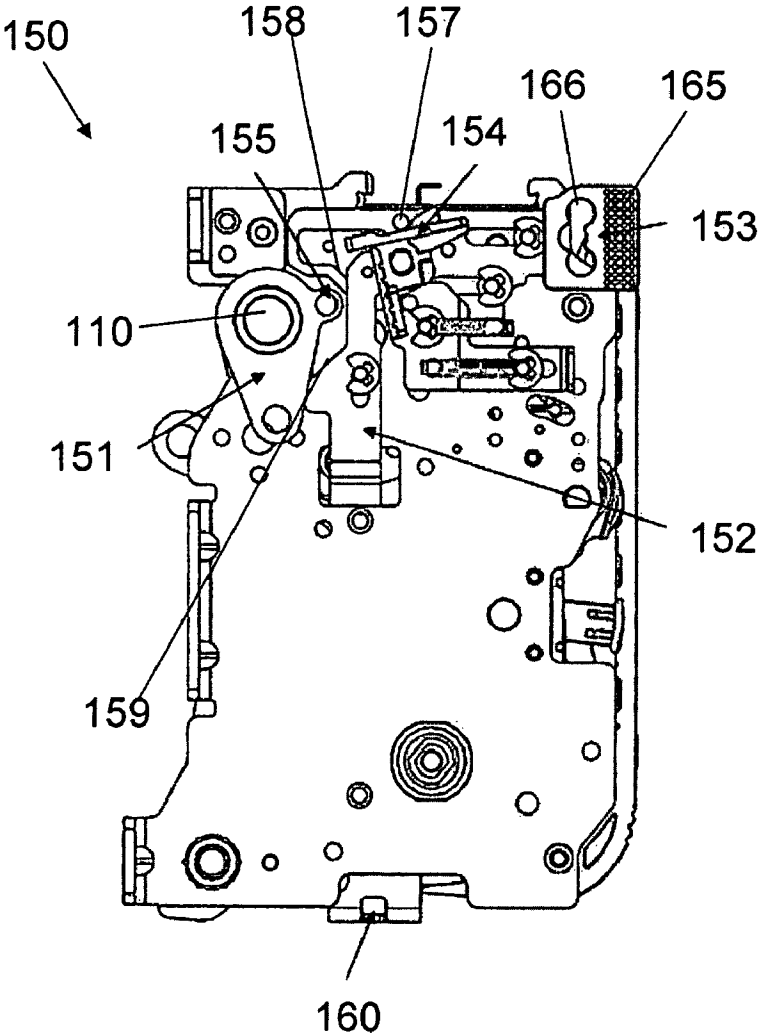
FIG. 2 illustrates a side view of a circuit breaker in an OFF condition in accordance with exemplary embodiments.

FIG. 2 illustrates a side view of the circuit breaker mechanism 150 in an OFF condition in accordance with exemplary embodiments. Furthermore, FIG. 3A illustrates a side view of the lifting plate 152 and FIG. 3B illustrates a side view of the padlock plate 153. As described above, the circuit breaker mechanism 150 includes the lifting plate 152, the trip paddle 154 and the padlock plate 153. The trip paddle 154 is disposed in between the lifting plate 152 and the padlock plate 153. In exemplary embodiments, the lifting plate 152 further includes a lifting roller 156, a blocking cam profile 159 and the lifting plate slot 160. In exemplary embodiments, the padlock plate 153 includes a grip 165, padlock apertures 166, a padlock pin 157 and a padlock lifting profile 158. As described further herein, the grip can be engaged by a user to shift the padlock plate 153 outwards from the circuit breaker 150 along the sidewall 170. In addition, a padlock or other locking mechanism can be inserted into the padlock apertures 166 when the padlock plate 153 is pulled outwards in this manner. Furthermore, as further described below, the padlock pin 157 is configured to engage and rotate the trip paddle.

Referring still to FIGS. 2, 3A and 3B, in exemplary embodiments, the lay shaft 110 includes a cam plate 151, which further includes a blocking pin 155. As described above, FIG. 2 illustrates the circuit breaker 150 in the OFF position, with the contacts open. FIG. 2 further illustrates the circuit breaker in an un-padlocked state in which the lifting plate 152 and the padlock plate 153 have not been engaged to lock the circuit breaker into a locked OFF position. In exemplary embodiments, when a user pulls out the padlock plate 153 by engaging the grip 165 and applying the outward force, the padlock plate profile 158 urges the lifting plate roller 156 upwards. However, as now described, this motion is prevented when the circuit breaker is in the ON condition as now described.

Figure 4:
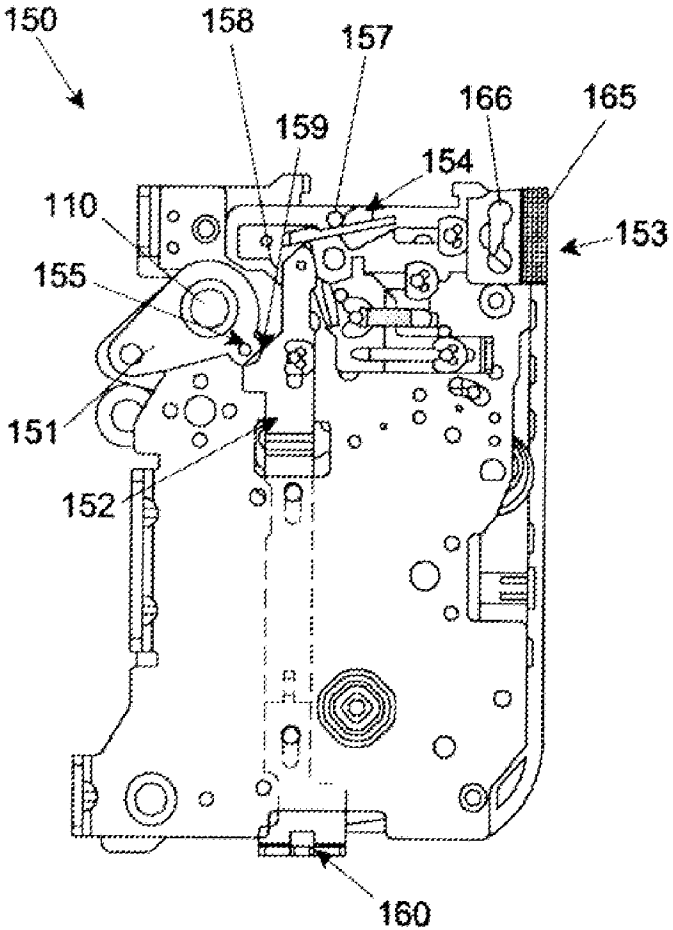
FIG. 4 illustrates a side view of a circuit breaker in an ON condition in accordance with exemplary embodiments.

FIG. 4 illustrates a side view of the circuit breaker 150 in an ON condition in accordance with exemplary embodiments. In this ON condition, the contacts are in contact and the lay shaft 110 is rotated such that the blocking pin 155 on the lay shaft cam 151 is rotated toward the lifting plate 152 and adjacent the lifting profile 159. Furthermore, in this ON condition an upward motion of the lifting plate 153 (i.e., the lifting profile 159) is impeded, or blocked by the blocking pin 155 on the lay shaft cam 151 (i.e., when the blocking pin 155 and the lifting profile 159 are in mechanical contact). Furthermore, in exemplary embodiments, the lifting plate roller 156 of the lifting plate 152 is coupled to the padlock plate profile 158 of the padlock plate 153. Therefore, as further described herein, the lifting plate cannot be displaced upward when the contacts are in the closed (i.e., when the circuit breaker 150 is in the ON condition). With the blocking pin 155 restraining the lifting plate 152, a user is unable to pull the padlock plate 153 outwards because the lifting plate roller 156 is also restrained from displacement upwards, the direction to which the padlock plate profile 158 would direct the lifting plate roller 156. As such, it is appreciated that when the circuit breaker 150 is in the ON condition with the lay shaft 110 rotated as described, a user is unable to padlock the circuit breaker 150. Furthermore, a user is unable to place a key lock lever 161 into the lifting plate slot 160 (described further with respect to FIG. 6) as the lifting plate 152 upward displacement is prevented.

In exemplary embodiments, it is appreciated that a trip free lock can be coupled to the circuit breaker 150. However, it is further appreciated that the circuit breaker 150 is to be placed and remain placed in an OFF condition when a trip free lock is placed on the circuit breaker 150. The exemplary systems described herein prevent the circuit breaker from being placed in the on condition when the circuit breaker is padlocked or otherwise locked as now described.

Figure 5A:
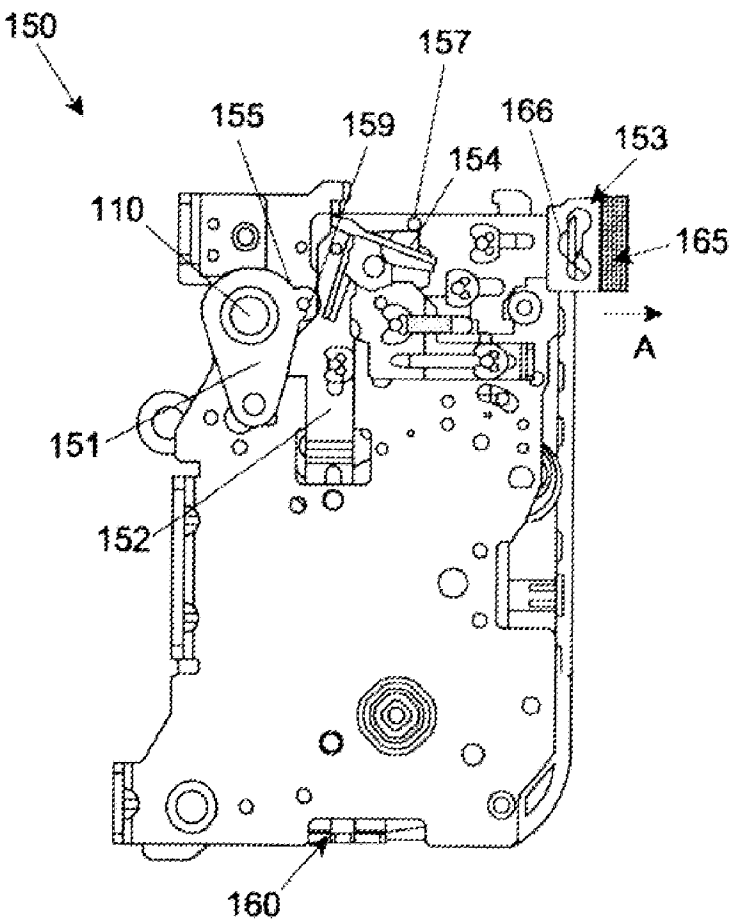
FIG. 5A illustrates a side view of a circuit breaker in an OFF condition in accordance with exemplary embodiments.

FIG. 5A illustrates a side view of the circuit breaker 150 in an OFF condition in accordance with exemplary embodiments. FIG. 5 illustrated a padlock-applied condition with the circuit breaker in the OFF condition. In the OFF condition, the lay shaft 110 is rotated such that the lay shaft cam 151 and the blocking pin 155 are rotated away from the lifting plate 152. In this way, the blocking pin does not impede the upward displacement of the lifting plate 152 via the lifting profile 159 as described above. As such, when a user engages the grip 165 and pulls the padlock plate 153 outward as described above and as shown by arrow A, the padlock pin 157 rotates the trip paddle 154 and keeps the trip paddle 154 in a trip free condition. In addition, in exemplary embodiments, the padlock plate profile 158 lifts the lifting plate 152 via the lifting plate roller 156. As such, with the padlock plate 153 pulled outwards, a user can apply a padlock to the padlock apertures 166 as well an inserting a key lock lever 161 into the lifting plate slot 160 (see FIG. 6). It is therefore appreciated that when a user desires to padlock the circuit breaker in a trip free and OFF condition, the user switches the circuit breaker to an OFF condition in which the contacts are open, and then pulls the padlock plate 153 as described, and further locks the circuit breaker as described.

Figure 5B:
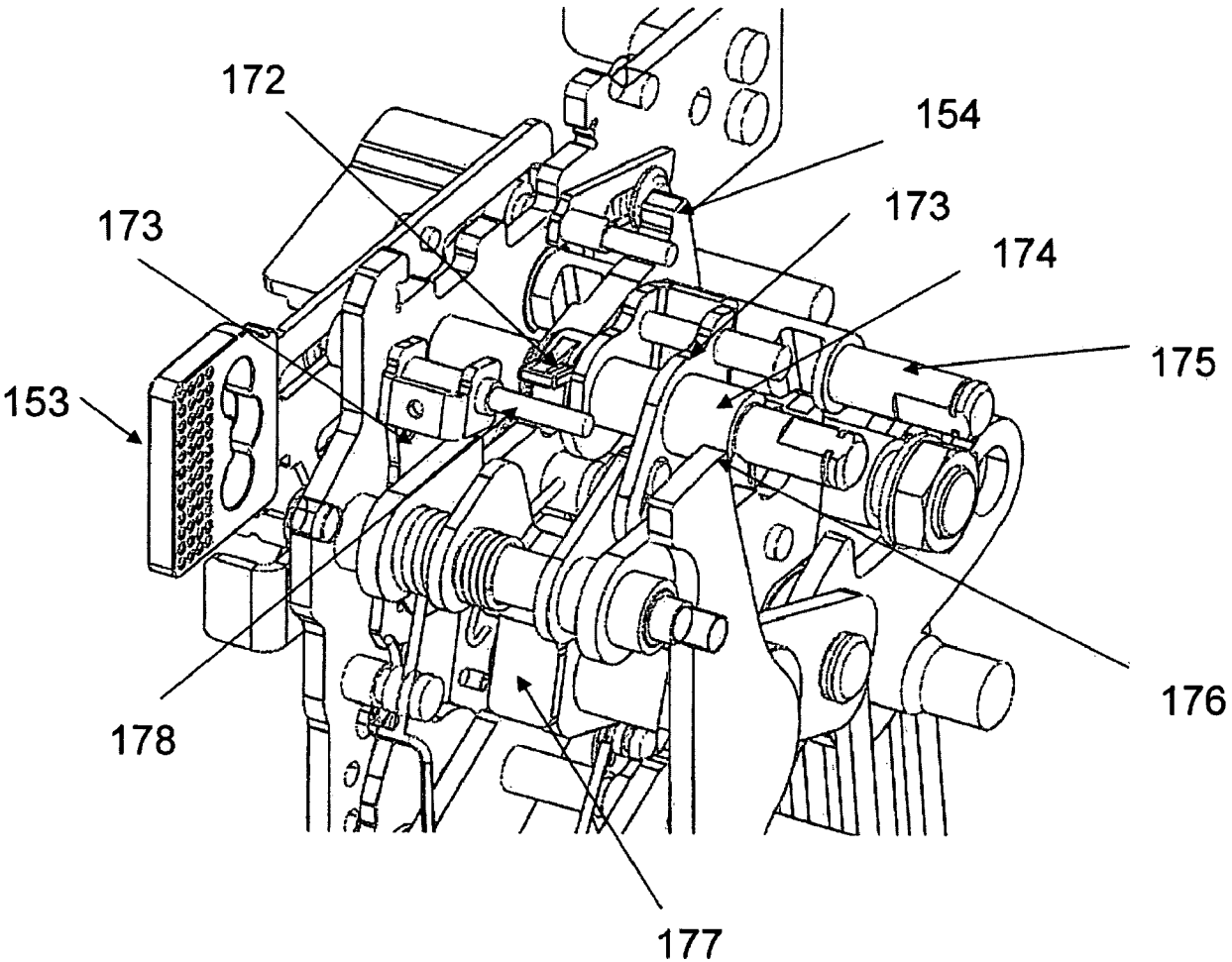
FIGS. 5B-5C illustrate perspective side views of the circuit breaker mechanism in a trip-free condition due to the application of Padlock.
Figure 5C:
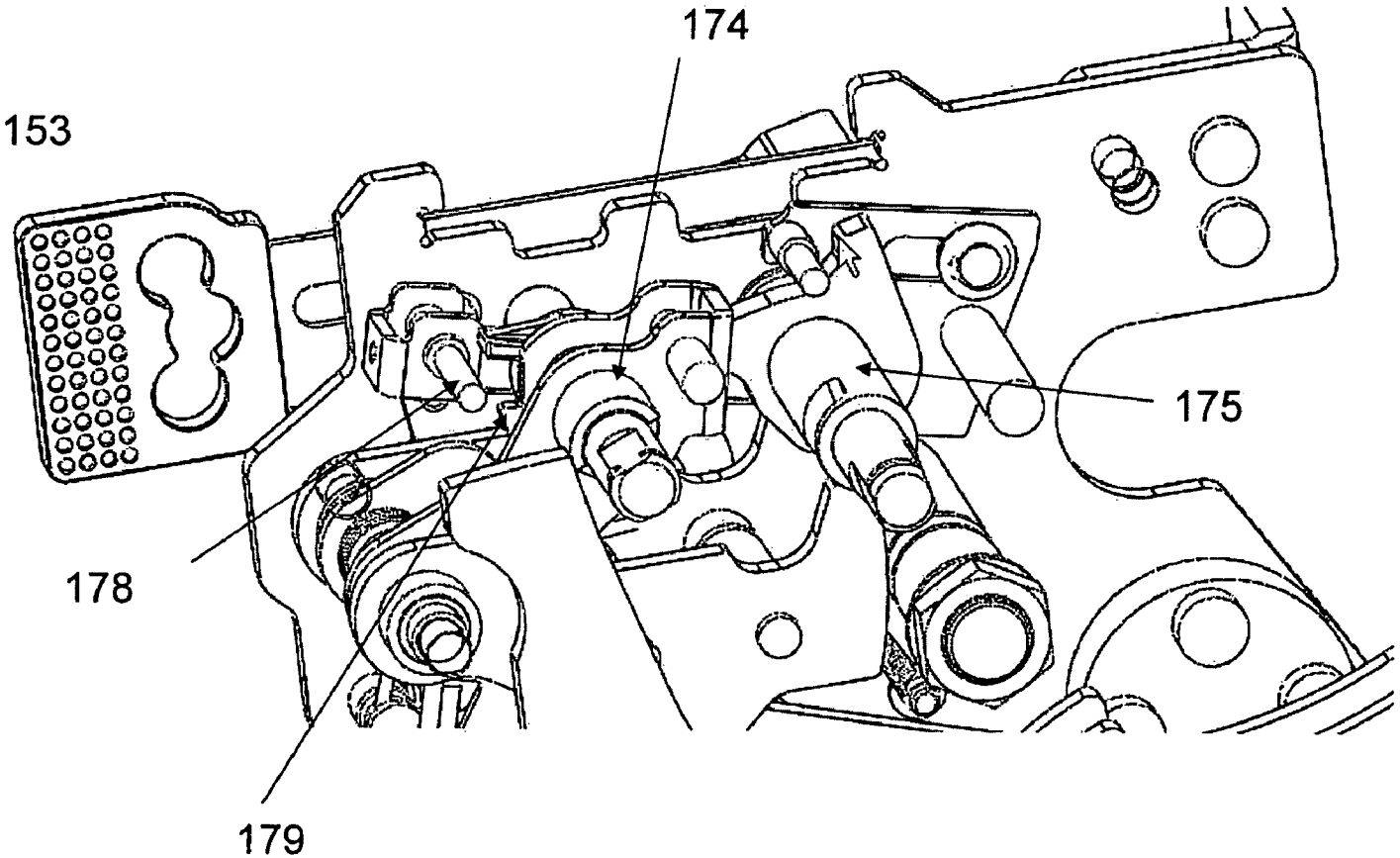

FIGS. 5B-5C illustrate perspective side views of the circuit breaker mechanism 150 in a trip-free condition. In exemplary embodiments, the circuit breaker mechanism 150 further includes a trip free plate 173 coupled to a trip free pin 178 configured to engage a close paddle 172 coupled to a closing shaft 174. In exemplary embodiments, the a closing shaft 174 is further coupled to a closing coupler 173 having a closing coupler profile 179. In addition, a trip shaft is coupled to the trip paddle 154 and to a latch 176. In exemplary embodiments, the circuit breaker mechanism 150 further includes a push on lever 177. In exemplary embodiments, for closing the circuit breaker mechanism 150, the latch 176 has to be released. In addition, to release the latch 176, the closing shaft 174 is rotated. In exemplary embodiments, in a normal (i.e., not trip-free) condition, a user presses the push on lever 177. By pressing he push on lever 177, the closing coupler 173 is rotated. In turn, the closing coupler profile 179 engages the trip free pin 178, which in turn, engages the closing paddle 172. The engagement of the closing paddle 172 results in a rotation of the closing shaft 174 thereby closing the latch 176, which is delatched. In exemplary embodiments, a trip free condition results by the application of a padlock, the circuit breaker mechanism 150 being in a closed condition, the application of some other interlock or the main springs (not shown) of the circuit breaker mechanism 150 being not charged (compressed). In this trip-free condition, the trip free plate 171 is moved to outwards. In addition, the closing coupler profile 179 cannot engage the trip free pin 178. As such, the closing shaft 174 cannot be rotated, as there is no coupling between the trip free pin 178 and closing paddle 172. In exemplary embodiments, a racking handle (not shown) is engaged to rack out and rack in the circuit breaker assembly 100. In exemplary embodiments, the lifting plate 152 us lifted up in order to engage the racking handle. As such, the circuit breaker mechanism is placed into an OFF condition in order to rack out and rack in.

Figure 6A:
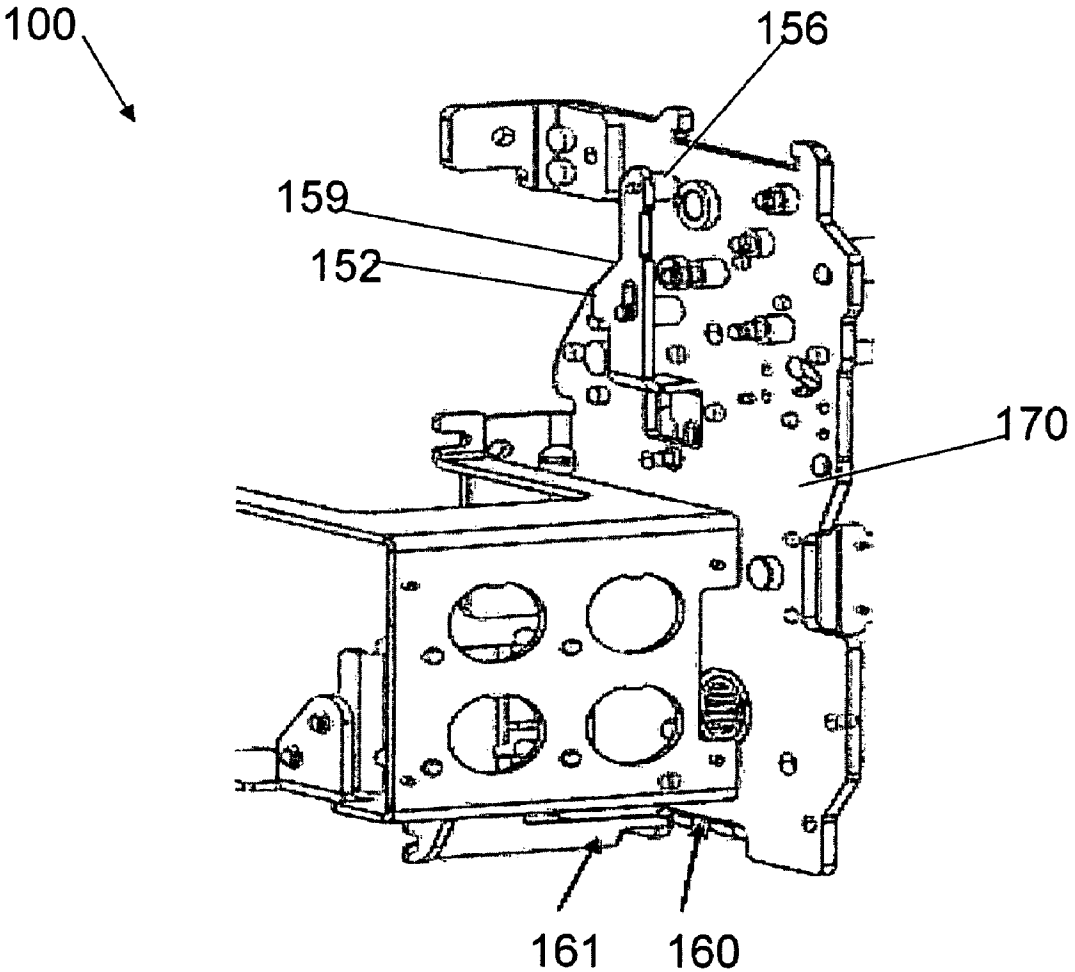
FIGS. 6A-6B illustrate a perspective side views of a circuit breaker mechanism in accordance with exemplary embodiments.
Figure 6B:
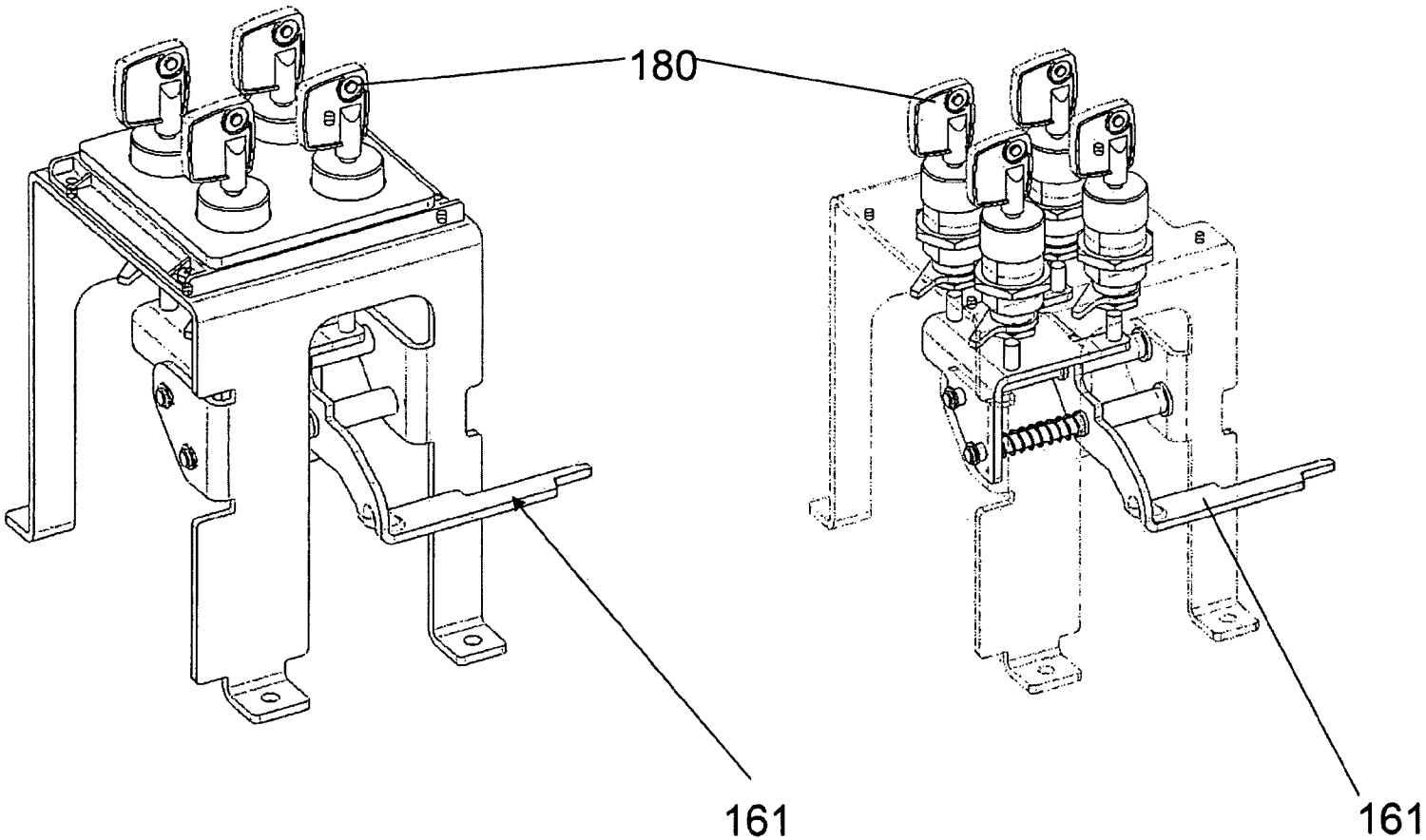

FIGS. 6A-6B illustrate a perspective side views of a circuit breaker 150 mechanism in accordance with exemplary embodiments. As described above, when the circuit breaker 150 is in the OFF condition and the padlock plate 153 is engaged outwards, the lay shaft 110 is prevented from rotating and thus the circuit breaker is locked into a trip free condition at which time a padlock can be inserted into the padlock apertures 166. In addition, the key lock lever 161 can be inserted into the lifting plate slot 160 via interlock keys 180, which locks the lifting plate 152 in the upwardly displaced position, thereby keeping the breaker in a trip free condition.

As such, it is appreciated that in order to place a circuit breaker in a trip free condition, which ensures that circuit breaker is switched OFF before applying any trip free locks, the user performs several steps as now described. As discussed herein, when the user desires to place the circuit breaker into a trip free locked condition, the user places the circuit breaker mechanism 150 in the OFF position, which rotates the lay shaft 110 such that the lifting plate 152 can displace upwards because the blocking pin 155 has been rotated upward from the lifting profile 159. The user then engages the padlock plate 153. As discussed herein, by engaging the padlock plate 153, the lifting plate 152 is displaced upward. In addition, the padlock pin 157 engages and rotates the trip paddle 154, thereby retaining the trip shaft in the rotated position as described. Once the user has engaged the padlock plate 153, the user can then engage the locking mechanism. As described herein, a padlock can be inserted into the padlock apertures 166. Similarly, the key lock lever 161 can be inserted into the lifting plate slot 160. Finally, the user can perform breaker operations that require the circuit breaker 150 to be retained in the OFF condition such as moving the circuit breaker 150 or performing maintenance on the circuit breaker 150.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus for a circuit breaker, comprising:
a lay shaft coupled to the circuit breaker;
a lay shaft cam coupled to the lay shaft;
a lifting plate configured to interface the lay shaft cam; and
a padlock plate configured to engage the lifting plate;
wherein the lay shaft cam includes a blocking mechanism;
wherein the blocking mechanism is a blocking pin; and
wherein the lifting plate includes a blocking cam profile configured to engage the blocking pin.

2. The apparatus as claimed in claim 1, wherein in a breaker closed condition, a vertical movement of the lifting plate is impeded by an engagement of the blocking pin with the blocking cam profile.

3. The apparatus as claimed in claim 1 further comprising a trip paddle disposed between the lifting plate and the padlock plate.

4. The apparatus as claimed in claim 3, wherein the padlock plate is coupled to the trip paddle.

5. The apparatus as claimed in claim 4, further comprising a padlock pin disposed on the padlock plate, the padlock pin configured to rotate the trip paddle.

6. The apparatus as claimed in claim 4 wherein the lifting plate further comprises a lifting plate roller coupled to a padlock lifting profile disposed on the padlock plate.

7. The apparatus as claimed in claim 4 wherein the padlock plate is configured to displace the lifting plate.

8. The apparatus as claimed in claim 7 wherein in response to a displacement of the padlock plate:
the lifting plate is displaced via the lifting plate profile and the lifting plate roller;
and the trip paddle is rotated.

9. A circuit breaker system, the system comprising:
a circuit breaker configured in an OFF condition;
a padlock plate disposed on the circuit breaker, wherein the engagement of the padlock plate locks the circuit breaker into a trip free condition; and
a locking mechanism configured to lock the circuit breaker in the OFF condition in response to the engagement of the padlock plate;
wherein the padlock plate is configured to be pulled the outward from the circuit breaker;
a lay shaft coupled to the circuit breaker;
a lay shaft cam coupled to the lay shaft;
a lifting plate configured to interface the lay shaft cam,
wherein the padlock plate is configured to engage the lifting plate;
a trip paddle disposed between the lifting plate and the padlock plate; and
a padlock pin disposed on the padlock plate and configured to engage a trip paddle.

10. The system as claimed in claim 9 further comprising a lay shaft coupled to the circuit breaker.

11. The system as claimed in claim 9 wherein a padlock plate profile disposed on the padlock plate engages a lifting plate roller disposed on a lifting plate.

12. The system as claimed in claim 11 wherein a blocking cam profile disposed on the lifting plate engages a blocking pin coupled to a lay shaft of the circuit breaker.

* * * * *